US005732829A

United States Patent [19]

Smith

[11] Patent Number: 5,732,829

[45] Date of Patent: Mar. 31, 1998

[54] SEPARATION APPARATUS AND METHOD FOR GRANULAR MATERIAL

[75] Inventor: Mark C. Smith, Rockville, Md.

[73] Assignee: Marcor Management, Inc., Hunt Valley, Md.

[21] Appl. No.: 631,159

[22] Filed: Apr. 12, 1996

[51] Int. Cl.[6] ..... B07C 5/00

[52] U.S. Cl. ..... 209/639; 209/135; 209/920

[58] Field of Search ..... 209/638–641, 209/135, 142, 920

[56] References Cited

U.S. PATENT DOCUMENTS

| | | | |
|---|---|---|---|
| 775,965 | 11/1904 | Edison . | |
| 977,956 | 12/1910 | Langerfeld | 209/638 X |
| 1,356,384 | 10/1920 | Marshall | 209/135 |
| 2,828,011 | 3/1958 | Whitby . | |
| 2,978,103 | 4/1961 | Cowher, Sr. . | |
| 3,757,946 | 9/1973 | Berkowitz et al. | 209/639 |
| 4,519,896 | 5/1985 | VIckery . | |
| 5,032,256 | 7/1991 | Vickery . | |
| 5,195,640 | 3/1993 | Seaverns . | |

FOREIGN PATENT DOCUMENTS

| | | | |
|---|---|---|---|
| 2535881 | 2/1977 | Germany | 209/135 |

OTHER PUBLICATIONS

Marcor drawing entitled "Marcor's Pneumatic Separation Unit".

Marcor drawing entitled "Pneumatic Separation Unit".

Marcor drawing entitled "Deflector Shield for Pneumatic Separation Unit".

*Primary Examiner*—Boris Milef

*Attorney, Agent, or Firm*—Roylance, Abrams, Berdo & Goodman, L.L.P.

[57] ABSTRACT

An apparatus for separating a mixed granular material into granules of different specific gravities or ranges of specific gravity using a powered air flow is described. A divider plate is located below the air flow path within the apparatus to separate the two material flows from each other. The divider plate can be rotated about an axis and can also be translated or displaced within the apparatus in order to precisely define the separation point between the material flows. Hoppers are used to collect and discharge the separated granular materials, and a conveyor belt is provided within the apparatus to transport one of the separated granular materials to the corresponding hopper. The conveyor belt reduces clogging of the separated granular material and also allows a greater degree of separation to be maintained between the hoppers, thereby allowing standard conveyors to be placed beneath the hopper discharge openings. The disclosed separation apparatus finds particular utility in the environmental remediation of outdoor firearm training facilities which have been contaminated with lead from used bullets, by allowing the lead bullets to be separated from rocks, soil and other debris for recycling.

11 Claims, 11 Drawing Sheets

SEPARATION APPARATUS AND METHOD FOR GRANULAR MATERIAL

FIELD OF THE INVENTION

The present invention is directed generally to separation apparatus, and is particularly concerned with an apparatus for separating a mixed granular material into granules of different sizes and/or specific gravities. The invention also relates to methods for separating mixed granular materials into granules of different sizes and/or specific gravities, and to methods for operating mixed granular material separation apparatus in accordance with the characteristics of the material being separated.

BACKGROUND OF THE INVENTION

There are many situations in which it is necessary to separate a mixed granular or particulate material into granules or particles of different sizes, specific gravities or both. One example, in connection with which the present invention finds particular utility, is the environmental remediation of outdoor firearm training facilities which have become contaminated with lead from used bullets. In order to restore these sites to an uncontaminated condition, the lead bullets must be removed from the soil and rocks with which they are mixed, and the soil and rocks must then be chemically treated to stabilize any lead which has leached from the bullets before being returned to the site. Mechanical screening can, at least to some degree, be used to separate the mixture of soil, rocks and bullets into its component parts; however, since mechanical screening relies on size differences between the granules or particles to be separated, it is not capable of separating rocks and bullets which are of the same or similar size. Such separation is necessary to allow for recycling of the lead (which requires a certain level of purity in the product to be recycled) and to avoid having to remove a larger volume of material from the site than is necessary. By separating the lead bullets from similarly sized rocks, the rocks can be returned to the site after being chemically treated and the lead bullets can be removed from the site in a relatively pure form for recycling and reuse.

Air separation (also known as dry separation) provides a method for separating mixed granular or particulate materials into their component parts by relying on differences in the specific gravity (rather than size) of the granules or particles to be separated. The theory of air separation is well understood, and is described, for example, in U.S. Pat. Nos. 2,828,011, 4,519,896 and 5,032,256, the disclosures of which are expressly incorporated herein by reference. Briefly, air separation is carried out by allowing the mixed granular or particulate material to fall vertically by gravity across a horizontal stream or flow of air. Assuming that all of the granules or particles are of approximately the same size (and hence experience approximately the same drag force from the moving air), granules or particles of greater mass will be accelerated move slowly by the moving air than those of lesser mass. As a result, the heavier granules or particles will fall closer to the initial drop point than the lighter granules or particles. By positioning hoppers or receptacles at these locations, the heavier and lighter granules or particles can be collected and processed separately. Additional examples of air separators may be found in U.S. Pat. Nos. 775,965 and 2,978,103.

In theory, air separation provides a useful way to separate lead bullets from rocks of similar size in an environmental remediation operation of the type described above. In reality, however, there are a number of problems with this approach.

For example, air separators are generally designed to operate with dry, easily separated granular or particulate materials, but the soil at an outdoor remediation site may be clumped or agglomerated as a result of precipitation, high clay content or other factors. This can result in poor separation between the rocks and lead bullets, in soil adhesion to both the rocks and lead bullets, and in clogging of the internal passages of the air separator. Another problem is the difficulty of adapting the air separator (whose geometry is generally fixed) to operate with granular or particulate materials other than those for which it was designed. In the case of an outdoor firing range, for example, the rocks found at different sites may have different specific gravities relative to that of lead; similarly, the lead to be removed from the site may in some cases consist of lead shot, which is relatively small in size, rather than lead bullets. In these situations, the use of an air separation process is practical only if the process can be adapted to the specific conditions encountered at the site.

Still another problem with existing types of air separators is the fact that the placement of the output hoppers or collection receptacles is dictated, at least to some extent, by the trajectories of the falling granular or particulate materials being separated. In air separators whose vertical dimensions or air flow rates are not large, the points at which the heavier and lighter granules or particles arrive at the bottom of the separator may be spaced apart by a relatively small horizontal distance. If hoppers or chutes are placed at these points and are arranged to discharge the separated granular materials vertically downward from the bottom of the separator, the discharge locations will also be relatively close together. This can be disadvantageous if, for example, the separated granular or particulate materials are to be discharged onto powered conveyors whose dimensions require that a certain minimum separation be maintained between them. It is possible to increase the distance between the discharge locations by angling the hoppers or chutes away from each other, but this results in discharge paths for the granular or particulate material that are more nearly horizontal and hence more prone to clogging, particularly if the granular or particulate material is wet or moist.

SUMMARY OF THE INVENTION

A primary object of the present invention is provide an apparatus which is capable of separating a mixed granular or particulate material into granules or particles of at least two different specific gravities or ranges of specific gravity, and which can be adjusted to accommodate the specific characteristics of the mixed granular or particulate material which is to be separated. As used herein, the terms "granules" and "particles" shall be regarded as equivalent (with the term "granules" being used to designate both), and the term "mixed granular material" shall refer to any granular, particulate, comminuted, pulverized or similar material containing granules, particles or other discrete components of at least two different specific gravities or ranges of specific gravity.

A further object of the invention is to provide an apparatus for separating a mixed granular material into granules of at least two different specific gravities or ranges of specific gravity, without requiring that the output hoppers or collection receptacles to be placed at locations dictated strictly by the trajectories of the falling granular materials being separated.

A further object of the invention is to provide an apparatus for separating a mixed granular material into granules of at least two different specific gravities or ranges of specific gravity, in which measures are taken to reduce or prevent clogging when the granular material is clumped or agglomerated due to moisture or other conditions.

A further object of the invention is to provide an apparatus for separating a mixed granular material into granules of different sizes and specific gravities, in which a mechanical screening apparatus is connected to an air separation apparatus by conveyors, with a diverter being used to recycle wet or moist granular material back to the mechanical screening apparatus without having passed through the air separation apparatus until the material has dried sufficiently to be processed by the air separation apparatus.

A still further object of the invention is to provide a separation apparatus which is useful for separating lead bullets from soil and rocks as part of an environmental remediation effort, but which is also useful for separating other types of mixed granular materials into their component parts.

In furtherance of the foregoing objects, the present invention provides an apparatus for separating a mixed granular material into granules of at least two different specific gravities or ranges of specific gravity, which apparatus comprises an air flow housing having a top, a bottom, an air inlet at one end thereof, and an air outlet at an opposite end thereof. A powered air flow source is provided for maintaining an air flow in the housing in a generally horizontal direction from the air inlet to the air outlet. A granular material feed assembly is provided for feeding a mixed granular material into the top of the housing and for allowing the mixed granular material to fall by gravity to the bottom of the housing while passing across the air flow produced by the powered air flow source. The air flow serves to separate granules of a first specific gravity or range of specific gravities from similarly sized granules of a second specific gravity or range of specific gravities that is less than the first specific gravity or range of specific gravities. A first granular material outlet is disposed in the bottom of the housing and is positioned relative to the granular material feed assembly in such a manner as to receive separated granules of the first specific gravity or range of specific gravities and discharge the granules from the housing. A powered conveyor belt is disposed in the bottom of the housing and is positioned relative to the granular material feed assembly in such a manner as to receive separated granules of the second specific gravity or range of specific gravities. A second granular material outlet is disposed in the bottom of the housing and is positioned relative to the powered conveyor belt in such a manner as to receive separated granules of the second specific gravity or range of specific gravities from the conveyor belt and discharge the granules from the housing.

In another aspect, the present invention is directed to an apparatus for separating a mixed granular material into granules of at least two different specific gravities or ranges of specific gravities which comprises, in addition to the air flow housing, powered air flow source and granular material feed assembly described above, a divider plate which is disposed in the housing and is positioned relative to the granular material feed assembly in such a manner as to maintain the separation between the granules of the first specific gravity or range of specific gravities and the granules of the second specific gravity or range of specific gravities. A first granular material outlet is disposed in the bottom of the housing for receiving separated granules of the first specific gravity or range of specific gravities and discharging the granules from the housing. A second granular material output is disposed in the bottom of the housing for receiving separated granules of the second specific gravity or range of specific gravities and discharging the granules from the housing. The divider plate extends horizontally across the housing in a direction substantially normal to the air flow direction, with an upper edge of the divider plate extending into the falling granular material. The divider plate is pivotable about a horizontal axis which extends transversely across the housing, and is displaceable in a direction generally along a longitudinal axis of the housing extending between the air inlet and air outlet.

In a still further aspect, the present invention is directed to an apparatus for separating a mixed granular material into granules of different sizes and specific gravities. The apparatus comprises a mechanical screening unit for pre-screening the mixed granular material to remove granules outside a predetermined size range, and an air separation unit for separating the pre-screened granular material into granules of different specific gravities or ranges of specific gravity. The apparatus also comprises a first conveyor for conveying the pre-screened granular material from the mechanical screening unit to the air separation unit, and a diverter for selectively returning the pre-screened granular to the mechanical screening unit without passing through the air separation unit. A second conveyor is provided for returning pre-screened granular material which has not passed through the air separation unit from the diverter to the mechanical screening unit.

The present invention is also directed to methods for separating a mixed granular material into granules of different sizes and/or specific gravities, and to methods for operating mixed granular material separation apparatus to accommodate different types of and characteristics of mixed granular materials. These methods may be carried out using the exemplary apparatus disclosed and claimed herein.

BRIEF DESCRIPTION OF THE DRAWINGS

The various objects, advantages and novel features of the present invention will be more clearly understood from the following detailed description when taken in conjunction with the appended drawings, in which.

Throughout the drawings, like reference numerals will be understood to refer to like parts and components.

DETAILED DESCRIPTION OF THE PREFERRED EMBODIMENT

Figure 1:
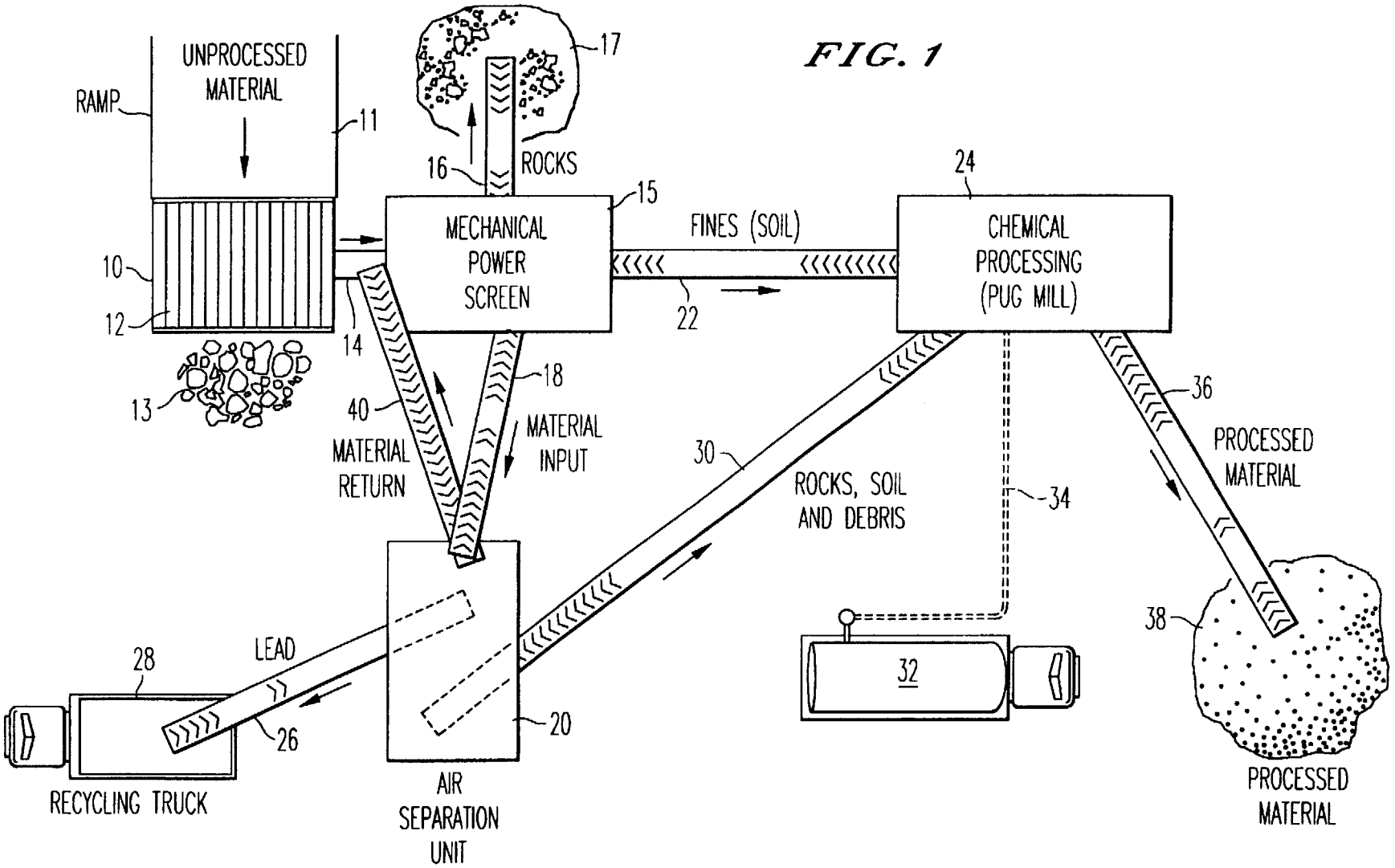
FIG. 1 is an overhead view of an environmental remediation site where a mixed granular material, consisting in the illustrated example of soil, rocks and lead bullets taken from an outdoor gun range, is required to be separated into its component pans before undergoing chemical processing and recycling.

FIG. 1 is a overhead view of an environmental remediation site employing the novel granular material separation apparatus and methods of the present invention. In the illustrated example, the site is an outdoor firearms training range where, over a period of time, used lead bullets have accumulated in large quantities in the soil and in protective earthen berms and backstops. The object of the remediation effort is to separate the lead bullets from the soil, rocks and debris with which they are mixed so that the lead bullets can be recycled, and to then chemically treat the soil, rocks and debris to stabilize any lead which may have leached from the bullets over time. The treated material may then be returned to the site, and the lead bullets transported to another location for recycling. In order to make the lead recycling step economically feasible, the purity of the lead bullets that are separated from the soil, rocks and debris must be approximately 70% or better by weight.

With continued reference to FIG. 1, unprocessed material that has been removed from the gun range is fed to an unpowered mechanical screening unit 10 by earthmoving equipment, such as a front-end unloader (not shown). A ramp 11 leads to the unpowered screening unit 10 to facilitate access by the front-end loader. In the screening unit 10, the unprocessed material is screened through inclined parallel bars 12 (visible from above in FIG. 1) spaced 4 inches apart to segregate boulders, rocks, brush logs and other large debris greater than 4 inches in diameter. This material, which does not require further processing before being restored to the site, is removed and deposited in a pile 13. Material passing through the 4-inch screening bars in the unpowered screening unit 10 is conveyed by a powered conveyor 14 to a two-layer, vibrating screening deck within a powered mechanical screening unit 15. The screening unit 15 may comprise a diesel-powered Chieftan Power Screen unit manufactured by Power Screen Distribution Ltd. of Dungannon, Northern Ireland and available from Stursa Equipment Company Ltd. of Glen Burnie, Md. The top screen of the deck is of a grid design with a dimension of 0.75 inch. Material that does not pass through the 0.75 inch screen is removed from the unit 15 by a conveyor 16 and deposited in a pile 17. This material does not require further processing and is used to reconstruct the berms and backstops at the remediation site. Material that passes through the 0.75 inch grid screen falls to a second screening deck comprising a 0.2 inch harp screen. This material, which is between 0.2 inches and 0.75 inches in size, consists primarily of bullets and similar-sized rocks (with a certain amount of adhered soil and other debris). The bullets and rocks are removed from the mechanical screening unit 15 by a second conveyor 18 and are introduced into an air separation unit 20, whose construction and operation will be described in detail hereinafter. The fine material that passes through the 0.2 inch harp screen, consisting primarily of soil and very small rocks, is carried by a third conveyor 22 to an industrial paddle mixer 24, conventionally known as a pugmill, where stabilization of the leached lead occurs. It will be understood that the mechanical screening unit 15 and pugmill 24 are conventional components whose construction and operation need not be described in detail. It will also be understood that the size of the screen openings in the powered mechanical screening unit 15 may be varied as necessary to suit the specific type of mixed granular material being screened.

The air separation unit 20 receives the mixture of rocks and bullets from the conveyor 18 and utilizes an internal air flow to separate these two components. (Typically, a substantial amount of soil adheres to the rocks and bullets that enter the air separation unit 20, particularly if the incoming material is wet due to precipitation or the like; this soil must also be separated from the bullets to the extent possible.) There are two hopper outlets (not visible in FIG. 1) at the bottom of the air separation unit 20, one for discharging the lead bullets which have been separated from the incoming material, and the other for discharging the rocks, soil and other debris from which the lead bullets have been separated. The bullets are carried by a conveyor 26 from the first hopper outlet to an open-topped truck 28, which accumulates the bullets and transports them to a recycling facility from time to time. A second conveyor 30 removes the separated rocks, soil and other debris from the second hopper outlet of the air separation unit 20, and conveys them to the pugmill 24. In the pugmill 24, this material is mixed with the finely divided soil and rocks delivered by the conveyor 22, and the composite material is chemically processed to stabilize any lead which may have leached from the bullets prior to separation. The chemical process involves the addition to the soil and rock mixture of a liquid material that forms an insoluble lead salt, and other materials that encapsulate and immobilize the lead salt. This stabilizes the mixture by preventing any remaining lead from leaching out. The liquid material used in the stabilization process is stored in a tanker truck 32 and supplied to the pugmill 24 by means of an underground line 34. After treatment in the pugmill 24, the processed mixture of rocks, soil and debris is discharged onto a conveyor 36 and deposited into a pile 38. Earthmoving equipment (not shown) may then be used to transport the processed material back to the gun range for reconstruction of the earthen berms, backstops and other structures.

FIG. 1 illustrates an additional conveyor 40 which operates in the direction from the air separation unit 20 to the powered mechanical screening unit 15. The conveyor 40, which is referred to as the return conveyor, operates in conjunction with a diverter plate (not shown in FIG. 1) located at the input of the air separation unit 20. In cases where the unprocessed material 10 is clumped or agglomerated due to excessive moisture, the diverter plate can be set to a position in which the material on the conveyor 18 is recirculated back to the input of the powered mechanical screening unit 15 by the return conveyor 40 without passing through the air separation unit 20. Preferably, this is done without introducing any new unprocessed material into the input of the powered mechanical screening unit 15. The agitation of the mixture of rocks and bullets as it passes repeatedly through the mechanical screening unit 15, together with the prolonged exposure to the atmosphere that occurs on the conveyors 18 and 40, assists in drying the mixture and in separating adhered soil from the rocks and bullets. When the desired amount of drying and soil release has taken place, the diverter plate is moved to the position in which the material on the conveyor 18 is allowed to enter the input of the air separation unit 20. Introduction of the new unprocessed material into the input of the mechanical screening unit 15 may then be resumed. If desired, the diverter plate and the input of the conveyor 40 can be coupled directly to the output of the mechanical screening unit 15, rather than to the input of the air separation unit 20. However, the arrangement shown is preferable since it provides a longer path for the mixture of rocks, bullets and debris to travel during the recycling operation, and hence a greater opportunity for drying and soil release to occur.

Figure 2:
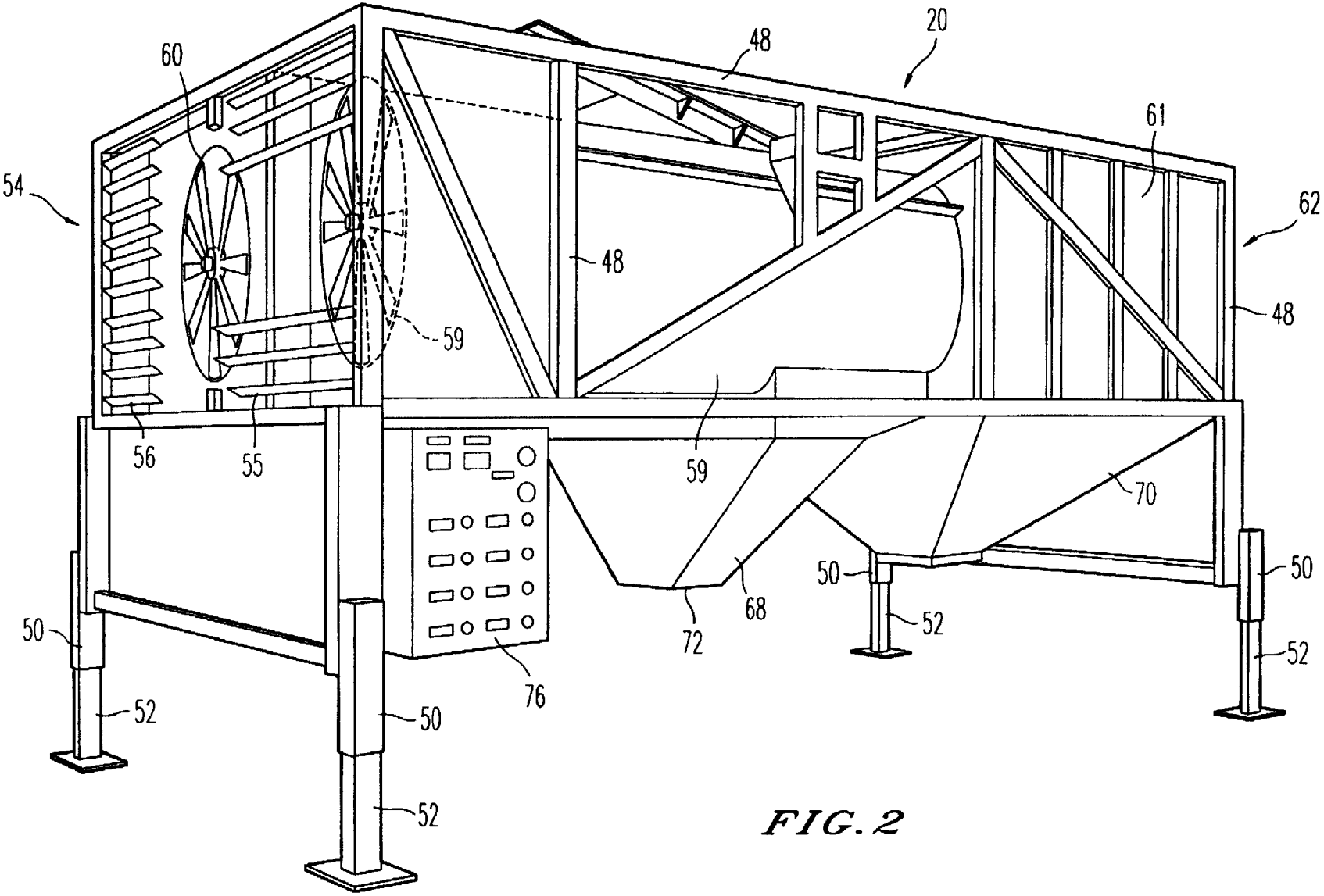
FIG. 2 is a perspective view of an air separation unit used at the environmental remediation site of FIG. 1, showing the air inlet end of the unit.
Figure 3:
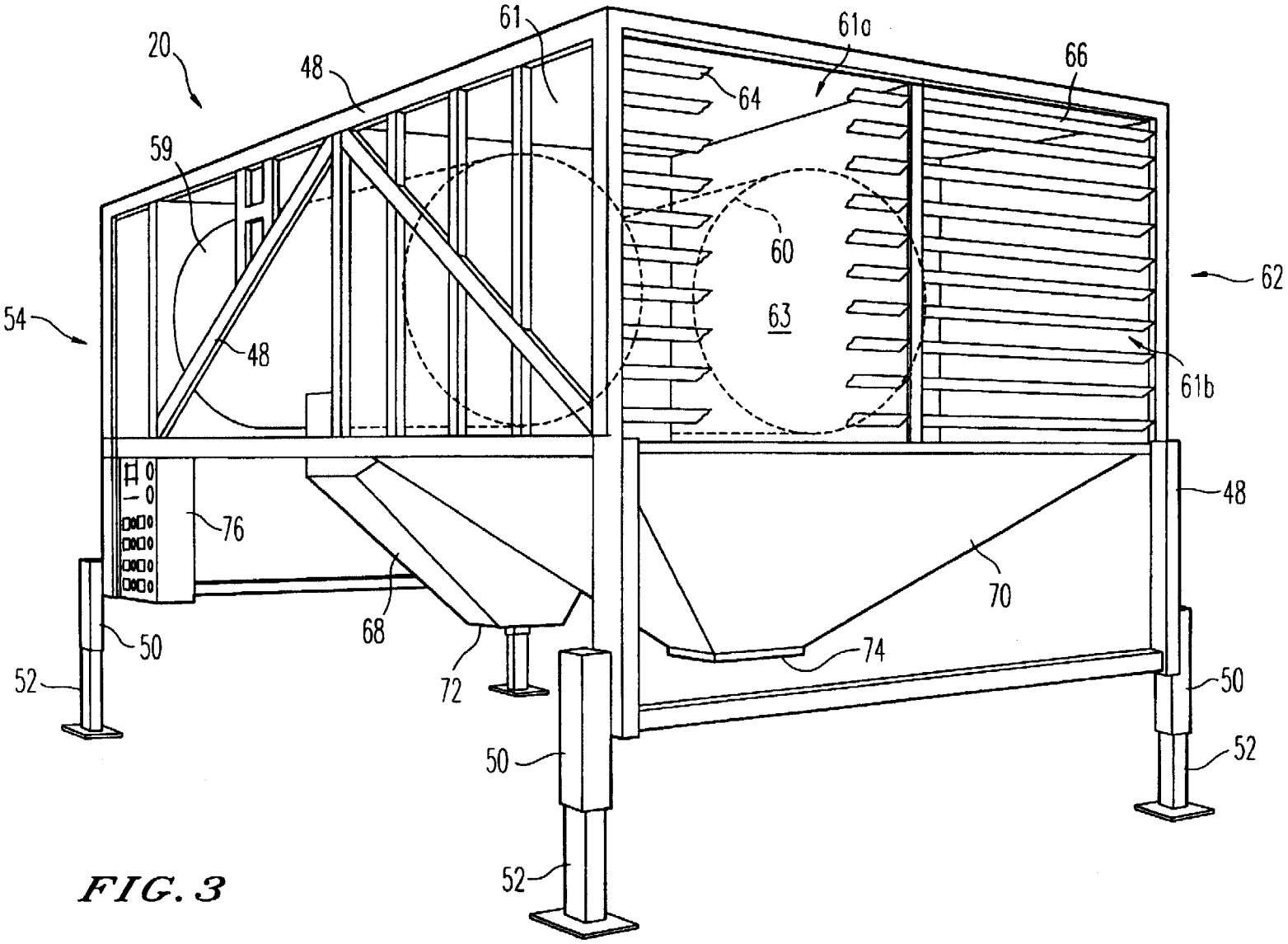
FIG. 3 is a further perspective view of the air separation unit of FIG. 2, showing the air outlet end of the unit.

FIGS. 2 and 3 are perspective views of the air separation unit 20, taken from opposite ends thereof. In the preferred embodiment, the air separation unit 20 is a freestanding unit which is approximately 18 feet in length, approximately 10 feet, 10 inches in width and approximately 12 feet in height. The unit 20 includes an outer steel frame 48 which is supported at its corners by four steel legs 50. The legs 50 include telescopic portions 52 which can be retracted to reduce the vertical height of the unit 20, thereby allowing it to be transported on a flatbed truck without exceeding vehicle height limits. At one end 54 of the unit 20, visible in FIG. 2, two sets of louvers or dampers 55 and 56 are fitted to provide air inlets for the unit. Two powered fans 57 and 58 are provided at the inlet end 54 of the unit 20 to provide a continuous flow of air through two parallel, cylindrical air flow tunnels 59 and 60. The two sets of louvers 55 and 56 are electrically controllable independently of each other and can be opened or closed in varying degrees to control the rate of air flow through the respective tunnels 59 and 60. When the air separation unit 20 is not in use, the louvers 55 and 56 can be completely closed, as shown, to protect the fans 57 and 58, fan motors and other internal components of the unit 20.

With continued reference to FIGS. 2 and 3, the two air flow tunnels 59 and 60 extend longitudinally from the inlet end 54 of the air separation unit 20 and terminate in a chamber 61 of rectangular cross-section located at the opposite end 62 of the unit. A partition 63 divides the chamber 61 into two halves **61*a* and 61*b*, each of which receives the air flow from one of the air flow tunnels 59 and 60. The end 62 serves as the air outlet end of the air separation unit 20, and includes two sets of louvers or dampers 64 and 66 (visible in FIG. 3) through which air is discharged from the unit. The two sets of louvers 64 and 66, like the corresponding sets of louvers 55 and 56 at the inlet end 54 of the unit 20, are electrically controllable independently of each other and can be opened or closed in varying degrees to vary the rate of air flow within the unit 20. In the closed position, illustrated in FIG. 3, the louvers 64 and 66 provide protection for the interior of the air separation unit 20 when the unit 20** is not in use.

Two hoppers 68 and 70 provide outputs for separated granular materials from the air separation unit 20. The first hopper 68 collects and discharges the heavier granular material (lead bullets) from the separation unit 20, and the second hopper 70 collects and discharges the lighter granular material (rocks, soil and debris) from the unit 20. The first hopper 68 communicates with the bottoms of the two air flow tunnels 59 and 60 at a point somewhat ahead of the junction between the tunnels and the chamber 61, while the second hopper 70 communicates with the bottom of the partitioned chamber 61. Although the interior of the air separation unit 20 is bifurcated into two independent air flow paths by the two air flow tunnels 59 and 60 and by the partition 63 in the chamber 61, each of the hoppers 68 and 70 communicates with both of the air flow paths within the unit 20. Thus, the hopper 68 receives lead bullets from openings in the bottoms of both air flow tunnels 59 and 60, and the hopper 70 (which extends below the bottom edge of the partition 63) receives rocks, soil and debris from both halves of the chamber 61. During use of the air separation unit 20, conveyors (not shown in FIGS. 2 and 3) are placed beneath the openings 72 and 74 of the respective hoppers 68 and 70, in order to transport the separated bullets and rocks, soil and debris away from the air separation unit 20. These conveyors correspond to the conveyors 26 and 30, respectively, of FIG. 1.

An electrical control panel 76 is mounted on the bottom portion of the air separation unit 20, adjacent to the air inlet end 54. The electrical control panel provides controls for operating the powered components of the air separation unit 20, including the fan motors, louvers, vibrating feed trays and internal conveyor belts. These components will be described in detail hereinafter.

Figure 4:
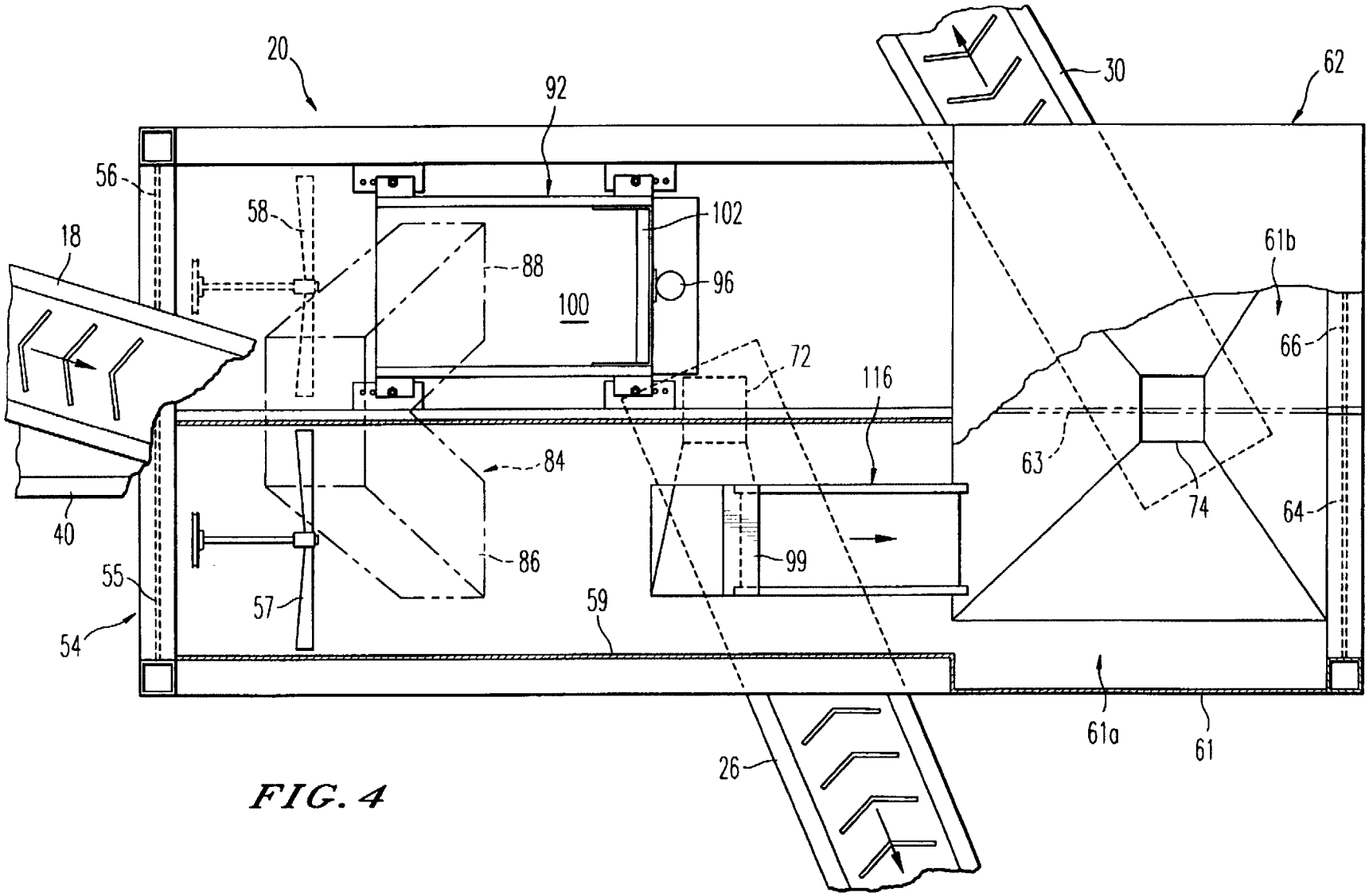
FIG. 4 is a top view of the air separation unit of FIGS. 2 and 3, with one of the two parallel air flow paths which make up the unit cut away to illustrate the internal details thereof.
Figure 5:
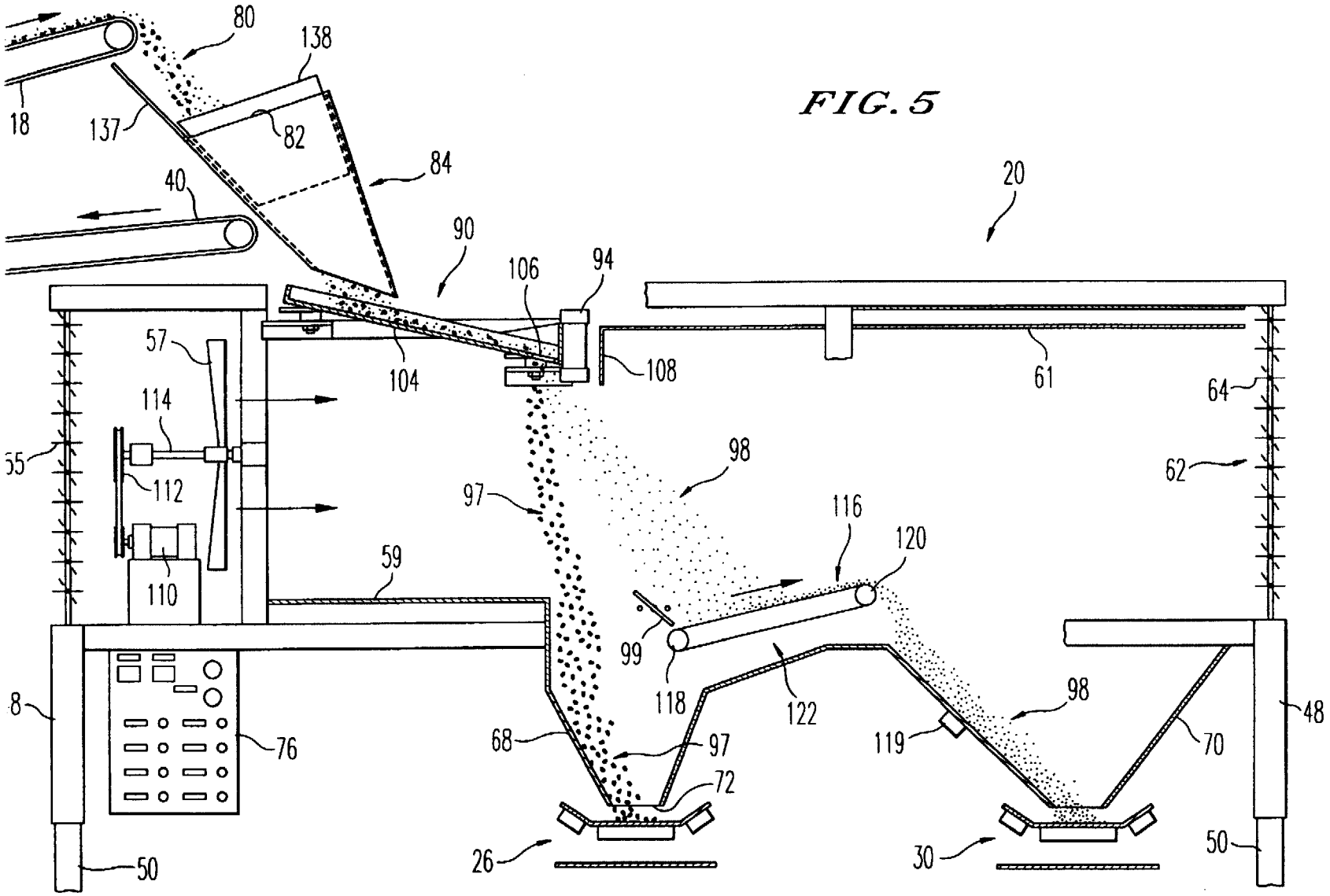
FIG. 5 is a side sectional view of the air separation unit of FIGS. 2–4, illustrating the components of one of the two parallel air flow paths.

The details of one of the two parallel air-flow paths within the air separation unit 20 are illustrated in FIGS. 4 and 5. FIG. 4 is a top view of the air separation unit 20, with the air flow tunnel 59 and the corresponding half **61*a* of the partitioned chamber 61 shown cut away to illustrate the air flow path which exists between the louvers 55 at the inlet end 54 and the corresponding louvers 64 at the outlet end 62. FIG. 5 is a side view of the air separation unit 20 (shown partially in section) illustrating the same air flow path. It will be understood that the second air flow path (extending between the inlet louvers 56 and outlet louvers 66 in FIG. 4) is a mirror image of the first air flow path, and hence only the first air flow path will be described in detail. The use of two parallel, independent air flow paths in the separation unit 20 increases the capacity of the unit 20, and also allows one air flow path to remain in operation in the event that the other air flow path becomes disabled due to clogging, equipment failure or the like. Although not shown in the illustrated embodiment, another advantage of this arrangement is that the material to be separated can be passed through the unit 20 twice, once through the first air flow path and once through the second air flow path. In practice, this would be done by initially introducing the starting material into the first air flow path, and then recycling the separated lead bullets from the output of the first air flow path to the input of the second air flow path. This requires a number of changes to the inputs and outputs of the air separation unit 20 (including the use of a separate bullet hopper 68 for each air flow path), but results in improved purity in the recyclable lead collected at the output of the unit 20**.

With continued reference to FIGS. 4 and 5, the mixed granular material 80 to be separated is carried to the separation unit 20 by means of the input conveyor 18, whose discharge end is positioned above the inlet end 54 of the unit 20 as shown. The mixed granular material 80 is allowed to fall from the discharge end of the conveyor 18 into the open top 82 of a feed hopper 84 (shown in phantom lines in FIG. 4 and illustrated in more detail in FIGS. 6–8) which is approximately in the shape of an inverted "V". Within the feed hopper 84, the flow of mixed granular material 80 is divided into two parts, one for each of the parallel air flow paths of the separation unit 20. The bottom of the feed hopper 84 has two outlets 86 and 88, from which the divided flows of mixed granular material 80 emerge. Each hopper outlet is positioned over the input end of a vibrating feed tray 90 or 92, respectively, with the first feed tray 90 being visible in FIG. 5 and the second feed tray 92 (which is identical to the first) being visible in FIG. 4. The feed trays 90 and 92 are mounted to the top of the air separation unit 20 in a manner to be described shortly, and serve to spread the mixed granular material across the width of the respective air flow paths. This allows more complete separation to occur within the unit 20, and also allows the maximum amount of mixed granular material 80 to pass through the air flows within the unit 20. Vibration of the feed trays 90 and 92 preferably occurs in a lateral direction (i.e., parallel to the plane of the trays) and is carried out by electric vibrator motors 94 and 96 which are mounted to the discharge ends of the feed trays. The motors 94 and 96 drive internal eccentric weights (not shown) which can be adjusted to provide a vibration force of between 300 and 1800 pounds. Suitable vibrator motors are available from Martin Engineering of Neponset, Ill. By individually adjusting the vibrator motors 94 and 96 to increase or decrease the amount of vibration of the trays 90 and 92, the feed rate of the mixed granular material 80 into each of the two air flow paths of the air separation unit 20 can be increased or decreased. The material feed rate can also be varied by changing the angles of the feed trays 90 and 92, as will be described shortly. Changing the feed rate of the mixed granular material 80 not only changes the effective throughput rate of the separation unit 20, but also changes the separation point between the bullets 97 and the rocks, soil and debris 98 at the bottom of the air stream. This can be compensated for by modifying the angle and/or position of an adjustable divider plate 99, as will also be described. At normal feed rates, dry mixed granular material emerging from the feed hopper 84 resides on the feed trays 90 and 92 for a period of 5 to 30 seconds before being fed into the air separation unit 20, and wet or moist mixed granular material resides on the feed trays 90 and 92 for an interval of 30 seconds to 2 minutes before entering the air separation unit 20.

Figure 8:
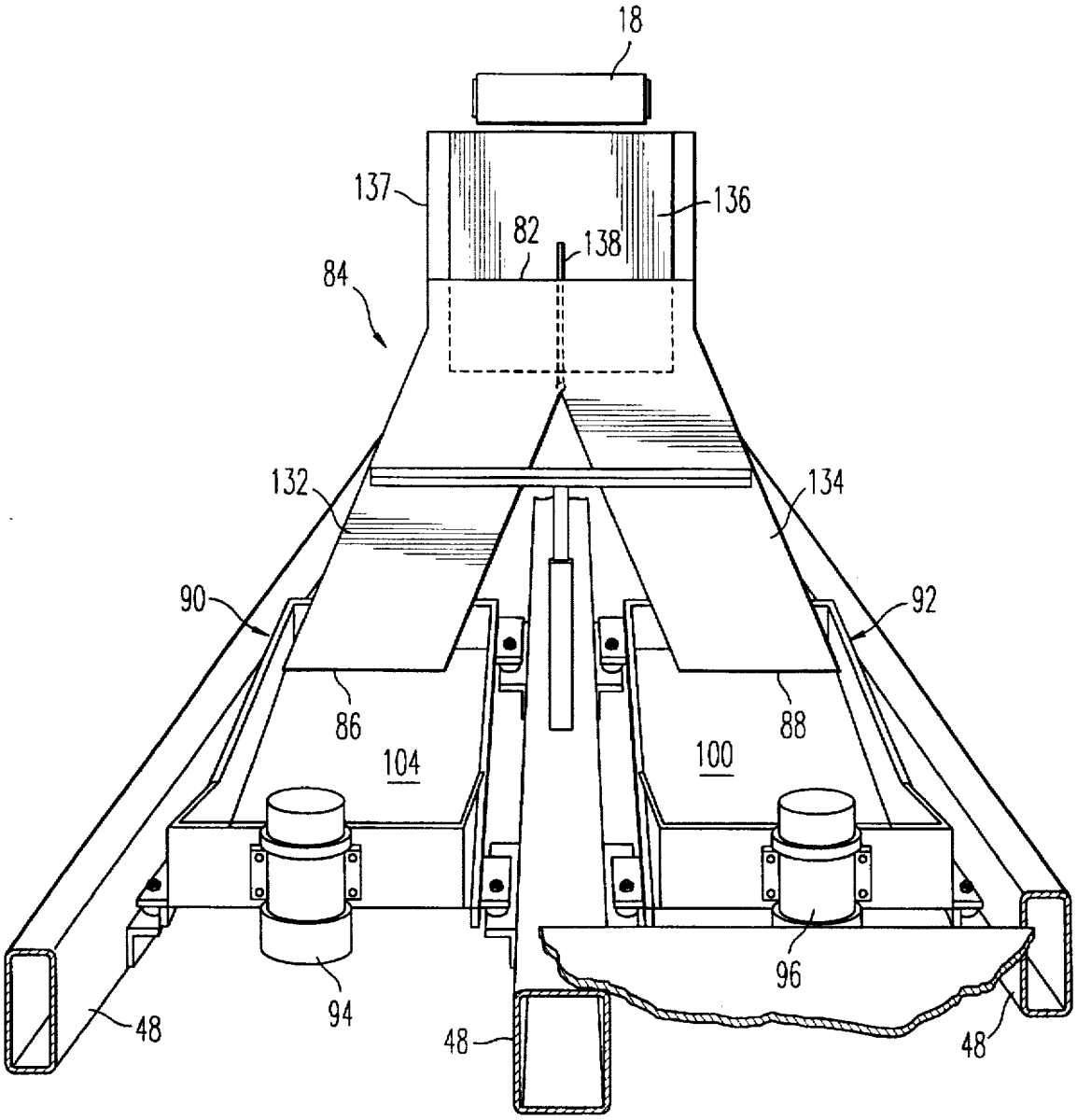
FIG. 8 is a perspective view of the top of the air separation unit of FIGS. 2–5 taken from the air outlet end thereof, showing the feed hopper of FIGS. 6 and 7 and the vibrating feed trays which receive mixed granular material from the feed hopper outlets and feed the material into the top of the air separation unit.

The electric vibrator motors 94 and 96 are generally cylindrical in shape and are shown in FIGS. 5 and 8 as being oriented with their axes vertical, which corresponds to a vertical orientation of the rotating shafts within the motors. Although this is an effective arrangement, it has been found that in some instances (particularly when the incoming mixed granular material is wet or moist), a horizontal orientation of the vibrator motors 94 and 96 is advantageous in reducing clumping or agglomeration of the mixed granular material. Preferably, the vibrator motors 94 and 96 are attached to their respective feed trays 90 and 92 by bolts or other removable fasteners, so that they can be removed and repositioned as necessary.

As shown most clearly in the top view of FIG. 4, the feed tray 92 has a planar surface 100 which carries the mixed granular material 80 and a rectangular discharge outlet 102 which allows the mixed granular material 80 to fall downwardly into the top of the air separation unit 20. The other feed tray 90, shown in FIG. 5, has a an identical surface 104 and outlet 106. The mixed granular material 80 which is discharged through the outlet 106 of the feed tray 90 in FIG. 5 falls downwardly through an opening 108 formed in the top of the cylindrical air flow tunnel 59, and is thus exposed to the air flow created by the fan 57. The fan 57 is powered by a 10-horsepower motor 110 via a belt-and-pulley coupling 112 and a shaft 114. The fan 57 generates an air flow of up to 41,820 cubic feet per minute (CFM) in free air, with an air velocity of approximately 40 to 50 miles per hour. The air flow produced by the fan 57 can be reduced in one of several ways, in order to conform to the type and condition of mixed granular material 80 entering the separation unit 20. One method is to move the inlet louvers or dampers 55 to a partially closed position (as shown in phantom) in order to increase the air flow resistance through the unit 20, thereby reducing the speed of the fan 57. The corresponding outlet louvers or dampers 64 may be adjusted in a similar manner, or may be allowed to remain in the fully open position. A second method is to connect an electrical speed controller (not shown) to the input of the motor 110, so that the speed variation can be achieved electrically. A third method is to allow the motor 110 to run at a constant speed, and to interpose a variable speed drive mechanism (not shown) between the motor 110 and shaft 114 in order to achieve the desired speed control mechanically. It will be apparent that more than one of these methods may be employed simultaneously, if desired.

The foregoing description of the fan 57 in FIG. 5 also applies to the fan 58 of FIG. 4, whose speed can be independently controlled by means of the corresponding louvers 56 and 66 or by any of the other methods discussed previously. Regardless of the method (or methods) chosen, suitable controls may be provided on the control panel 76 to allow an operator to vary the speed of the fans 57 and 58 as necessary, and gauges or indicators may also be provided to inform the operator of the current air speed or volumetric rate of air flow.

As the mixed granular material 80 falls downwardly across the air flow produced by the fan 57 of FIG. 5, separation occurs between the granules of higher specific gravity (i.e., the lead bullets 97) and the granules of lower specific gravity (i.e., the rocks, soil particles and other debris 98). As illustrated, this separation occurs horizontally, in a direction aligned with the air flow produced by the fan 57, and results in the lead bullets 97 reaching the bottom of the air flow tunnel 59 at a location closer to the initial drop point below the feed tray outlet 106 than the rocks, soil and debris 98. The lead bullets are collected in the hopper 68 (which, as noted previously, is shared by both of the air flow tunnels 59 and 60 in the preferred embodiment) and are discharged onto the conveyor 26 through the opening 72. In the design of the air separation unit 20, the location of the hopper 68 is chosen to correspond with the expected trajectory of the heavier granules 97; however, this trajectory will obviously depend to some extent on the nature and size of the granules 97 themselves. Therefore, to allow for some degree of fine tuning, several parameters of the air separation unit 20 may be varied. In the preferred embodiment, these include the feed rate of the input conveyor 18, the amount of vibration applied to the feed tray 90, the angle of the feed tray 90 relative to the horizontal, the horizontal position of the feed tray 90 relative to the opening 108 (which controls the initial drop point of the mixed granular material 80 into the air flow tunnel 59), and the speed of the fan 57. By controlling these parameters individually or in combination, the trajectory of the lead bullets 97 can be adjusted so that the bullets 97 fall directly into the hopper 68. In the same way, the trajectory of the soil, rocks and debris 98 (and the separation point between the lead bullets 97 and the soil, rocks and debris 98) can be controlled.

After separation occurs between the lead bullets 97 and the soil, rocks and debris 98, the soil, rocks and debris 98 pass over the divider plate 99 and are deposited onto a powered conveyor belt 116. The conveyor belt 116, which operates in the direction indicated by the arrow, is referred to as the waste belt or waste conveyor since it transports the "waste" (non-recyclable) material that has been separated from the recyclable lead. The input end 118 of the waste belt 116 is located below the divider plate 99, at a point corresponding to the expected trajectory of the soil, rocks and debris 98 following separation from the lead bullets 97. This trajectory can be adjusted by varying the parameters mentioned earlier until the soil and rocks 98 fall consistently at the proper point on the waste belt 116. The principal function of the waste belt 116 is to transport the soil, rocks and debris 98 from the point where they are deposited (which will, in most cases, be on or immediately to the right of the divider plate 99) to the waste hopper 70. In this way, the waste hopper 70 is not required to be located immediately adjacent to the bullet hopper 68, and hence the openings 72 and 74 of the respective hoppers can be spaced far enough apart to accommodate standard conveyors 26 and 30. The waste belt 116 is also useful in preventing the soil, rock and debris 98 from collecting and jamming in the bottom of the air separation unit 20, which can otherwise occur when the mixed granular material 80 that is being fed to the unit 20 is wet or damp. Clogging of the material discharged from the waste belt 116 into the waste hopper 70 can be reduced by attaching an optional electric vibrator motor 119 to the outside of the waste hopper 70.

As will be evident from FIG. 5, the waste belt 116 inclines slightly upward (at an angle of about 12°) between its input end 118 and its discharge end 120. The divider plate 99 and the major portion of the waste conveyor 116 are mounted in a recessed bottom portion 122 of the unit 20 and are thus shielded from the direct air flow produced by the fan 57. This is advantageous in avoiding any eddies, backdrafts or other disturbances in the air flow produced by the fan 57. Such disturbances could otherwise reduce the separation efficiency of the unit 20, particularly if they occur near the separation point between the lead bullets 97 and the soil, rocks and debris 98. The recessed location of the waste conveyor is also advantageous in that the air flow from the fan 57 does not act on the soil, rocks and debris 98 that are carried on the waste conveyor 116, and hence the rate of movement of this material is controlled only by the speed of the conveyor belt. The discharge end 120 of the waste conveyor 116 protrudes slightly upward into the air flow produced by the fan 57 to assist in directing the air flow through the louvers or dampers 64 at the outlet end of the unit 20 and not into the waste hopper 70. Air flow into the waste hopper 70 is undesirable since the waste hopper 70 is common to the two air flow paths within the unit 20, and hence any air flow into the waste hopper 70 from one air flow path may disturb the other air flow path (e.g., by creating a backdraft in the other air flow path or by drawing air from the other air flow path due to the venturi effect). Even a slight difference between the air flows in the two air flow paths can cause an imbalance in the unit 20 and a consequent reduction in its separation efficiency.

The divider plate 99 maintains the desired separation between the bullets 97 and the soil, rock and debris mixture 98 as these materials are conveyed to their respective hoppers 68 and 70. To accomplish this, the divider plate 99 is oriented with its upper edge extending into the downwardly falling granular material and its lower edge facing the waste conveyor 116, as shown. The lower edge of the divider plate 99 is preferably close to, but does not touch, the waste conveyor 116. In this way, the divider plate 99 serves not only to initially divide the flow of bullets 97 from the flow of soil, rocks and debris 98, but also to prevent rocks which strike the input end 118 of the waste conveyor 116 from bouncing or scattering in the reverse direction toward the hopper 68. By virtue of this barrier function, the divider plate 99 increases the reliability and consistency of separation between the bullets 97 and the soil, rocks and debris 98. As will be described in more detail hereinafter, the divider plate 99 can be adjusted to precisely define the desired separation point between the two material flows 97 and 98. Two adjustments are possible, one consisting of a pivoting or rotation of the divider plate 99 about an axis normal to the page in FIG. 5, and the other consisting of a displacement or translation of this axis to the right or left in FIG. 5. Both of these adjustments serve to reposition the upper edge of the divider plate 99, with the first adjustment serving as a fine adjustment the second adjustment serving as a coarse adjustment. Along with adjustment of the other parameters described previously, the ability to adjust the position and orientation of the divider plate 99 allows the operation of the air separation unit 20 to be modified as necessary to suit the type and condition of the mixed granular material 80 being separated. It will be observed from FIG. 5 that, since the divider plate is located just above the lower (input) end 118 of the waste conveyor 116, the divider plate is shielded from the direct air flow produced by the fan 57. This is useful in preventing any disturbance of the air flow near the separation point between the lead bullets 97 and the waste material 98, as discussed earlier.

As indicated in FIG. 5, some of the heavier rocks in the material flow 98 have a trajectory which carries them initially into contact with the divider plate 99, rather than into contact with input end 118 of the waste conveyor 116. When these rocks strike the divider plate 99, the inclination of the divider plate 99 causes them to bounce or scatter toward the waste conveyor 116 rather than toward the bullet hopper 68. In this way, the desired separation between the lead bullets 97 and rocks 98 is maintained. It will also be observed that the divider plate 99 performs a protective function by absorbing the impact of the heavier rocks and thereby preventing excessive wear on the surface of the waste belt 116.

Figure 6B:
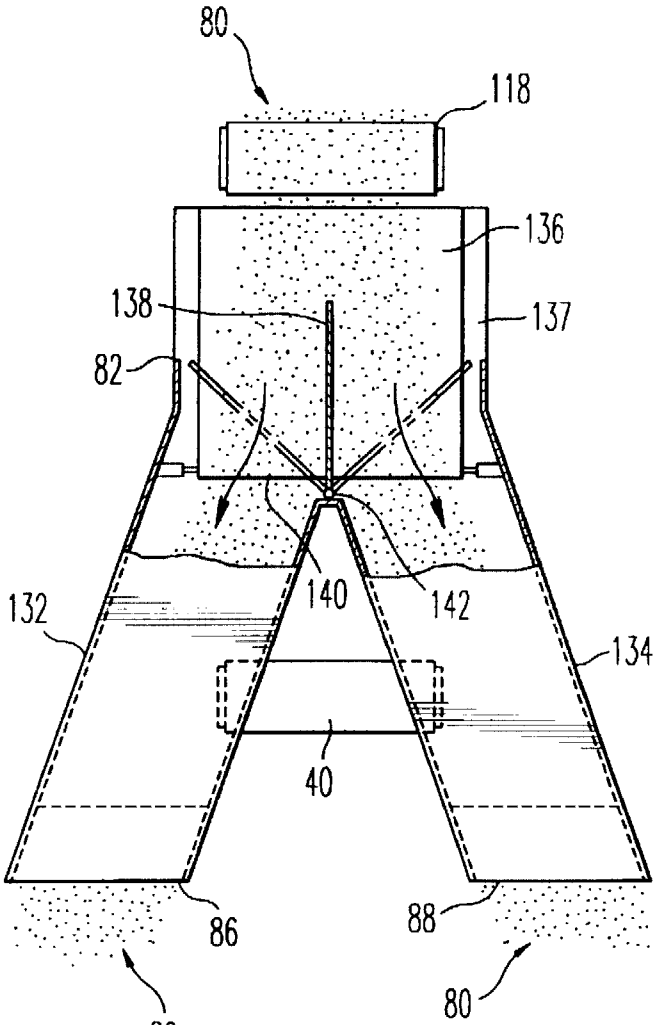
FIGS. 6A and 6B are side and end views, respectively, of a feed hopper which delivers a mixed granular material into the air separation unit of FIGS. 2–5.
Figure 6A:
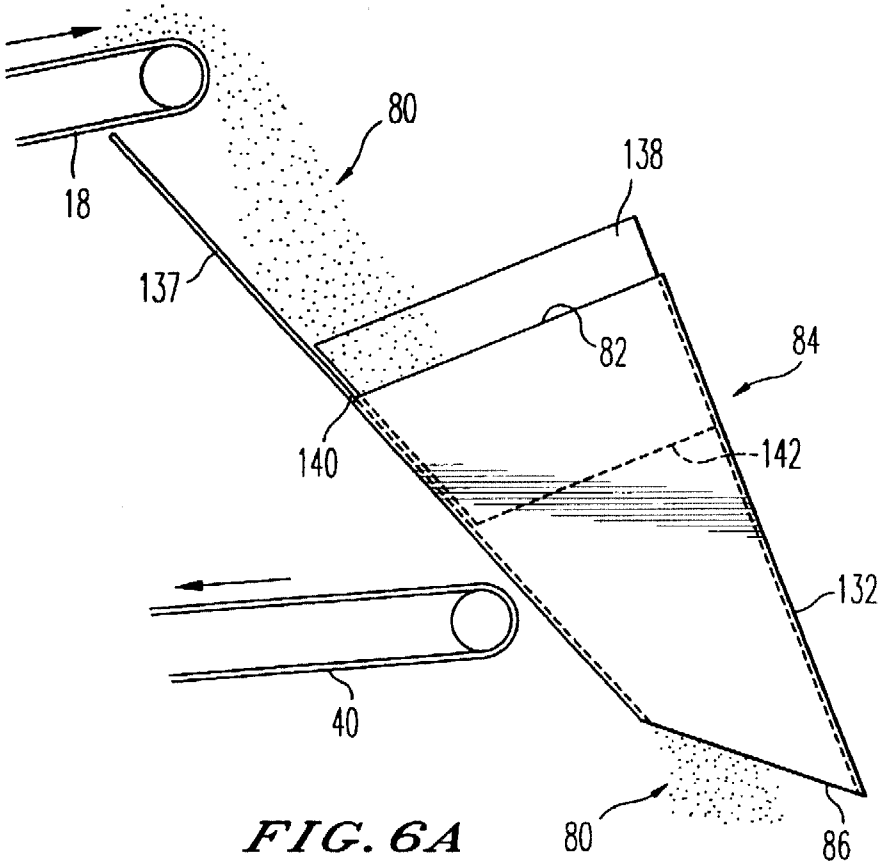
Figure 7B:
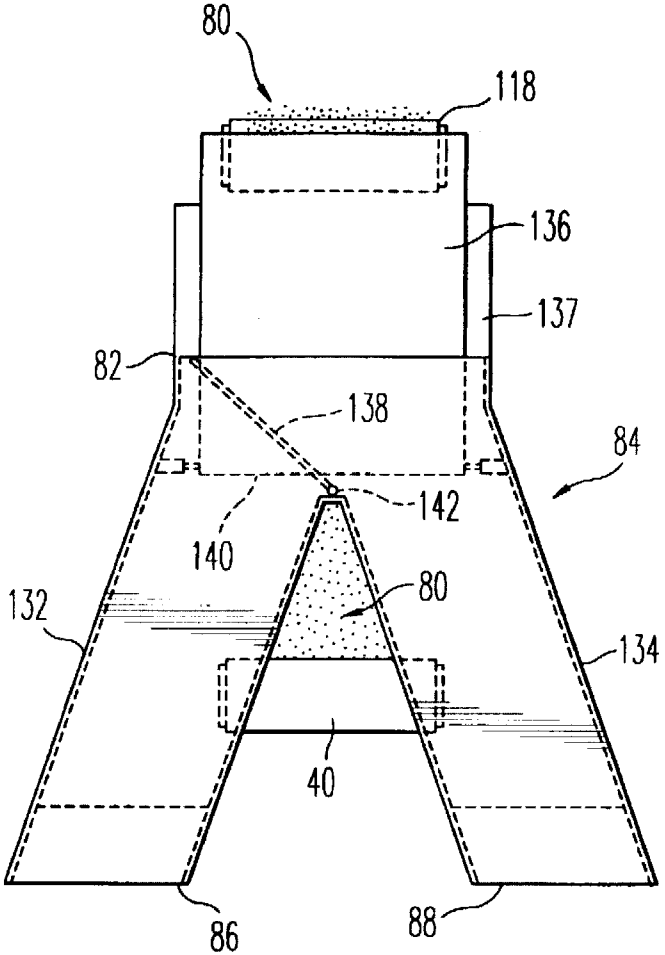
FIGS. 7A and 7B are side and end views similar to those of FIGS. 6A and 6B, respectively, except that a diverter plate within the feed hopper has been moved to a position in which the mixed granular material is diverterted to a recycling conveyor without entering the air separation unit.

The detailed construction and operation of the feed hopper 84 is illustrated in FIGS. 6 and 7. As noted previously, the feed hopper 84 is generally in the shape of an inverted "V", with a single top opening 82 for receiving mixed granular material 80 from the conveyor 18 and two downwardly-extending legs 132 and 134 which are angled away from each other to align with the feed trays 90 and 92 of FIGS. 4 and 5. (This relationship will also be apparent from FIG. 8.) The feed hopper 84 is provided with two movable diverter plates 136 and 138. The first diverter plate 136 (preferably provided as a cut-out in the planar rear wall 137 of the feed hopper 84) extends transversely across the width of the top opening 82, and has its bottom edge pivotably connected to the feed hopper 84 along a hinge axis 140. The second diverter plate 138 extends longitudinally across the top opening 82 and has its bottom edge pivotably attached to the feed hopper 84 along a hinge axis 142. The hinge axis 142 is located at the apex or intersection point between the two legs 132 and 134 of the feed hopper 84, as shown in FIGS. 6B and 7B.

The position of the first diverter plate 136 determines whether the granular material 80 carried by the input conveyor 18 is allowed to enter the feed hopper 84 or is diverted onto the conveyor 40 for recycling and drying in the manner described previously in connection with FIG. 1. In the position of the first diverter plate 136 shown in FIGS. 6A and 6B, the mixed granular material 80 is directed into the feed hopper 84 rather than onto the recycling conveyor 40. That being the case, the position of the second diverter plate 138 determines whether the flow of mixed granular material 80 will be divided between the two legs 132 and 134 of the feed hopper (as will normally be the case) or restricted to only one of the two legs 132 and 134 of the feed hopper 84. The three possible positions of the second diverter plate 138 are shown in FIG. 6B. In the center position, the second diverter plate 138 extends upwardly into the downwardly falling granular material 80 and divides the material flow so that an approximately equal portion of the material falls through each leg 132 and 134 of the feed hopper 84. In the right-hand position of the second diverter plate 138, the leg 132 of the material 80 passes only through the left-hand leg 132 of the feed hopper 84, and hence separation of the mixed granular material 80 occurs only in the first of the two air flow paths of the separation unit 20 (i.e., the path which includes the air flow tunnel 59). Conversely, in the left-hand position of the second diverter plate 138, the mixed granular material 80 passes only through the right-hand leg 134 of the feed hopper 84, and hence separation occurs only in the second air flow path of the unit 20 (corresponding to the air flow tunnel 60). As mentioned earlier, both of the air flow paths within the separation unit 20 are normally used simultaneously, except in instances where one air flow path is disabled due to clogging or equipment failure. In these latter instances, the second diverter plate 138 is moved from the center position to either the right-hand or left-hand position, thereby isolating the disabled air flow path and allowing the necessary repairs to be made.

Figure 7A:
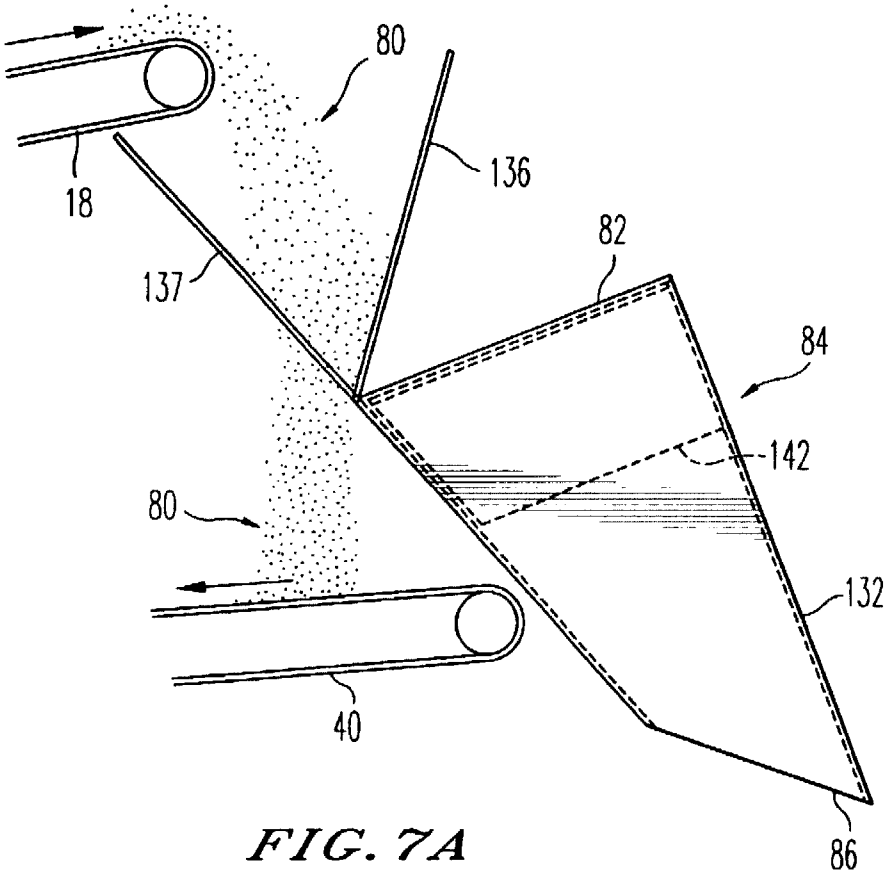

FIGS. 7A and 7B illustrate the first diverter plate 136 in the recycling position. In this position, the first diverter plate 136 intercepts the flow of mixed granular material 80 from the input conveyor 18 and does not allow the material to enter the top opening 82 of the feed hopper 84. Instead, the first diverter plate acts as a deflector and causes the material 80 to fall onto the return conveyor 40, which transports the material back to the mechanical screening unit 12 of FIG. 1. The position of the second diverter plate 138 is not relevant in this situation; however, to prevent mechanical interference with the first diverter plate 136 in the preferred embodiment, the second diverter plate 138 must be moved either to its left-hand or right-hand position when the first diverter plate 136 is in the recycling position.

Figure 9:
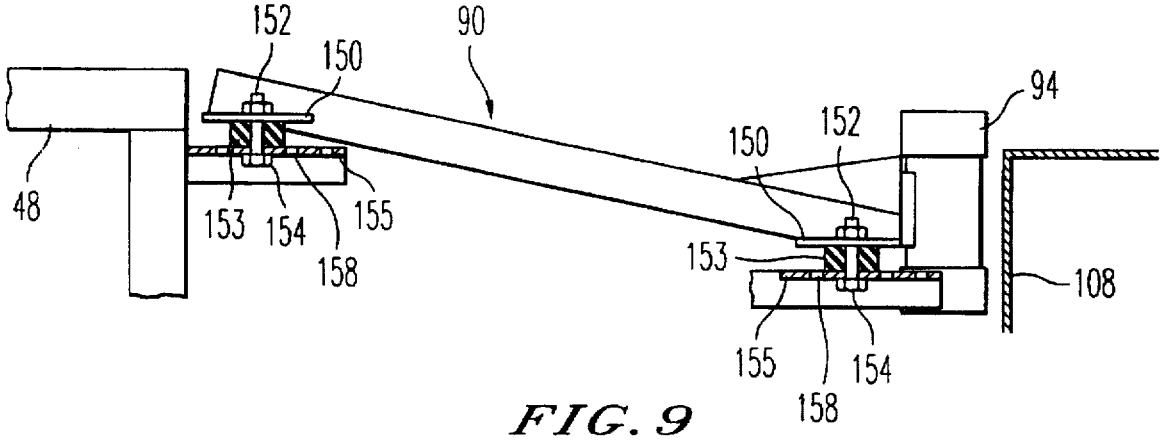
FIG. 9 is a side view, shown partially in section, of one of the vibrating feed trays which receive the mixed granular material from the feed hopper and feed the material into the top of the air separation unit of FIGS. 2–5.
Figure 10:
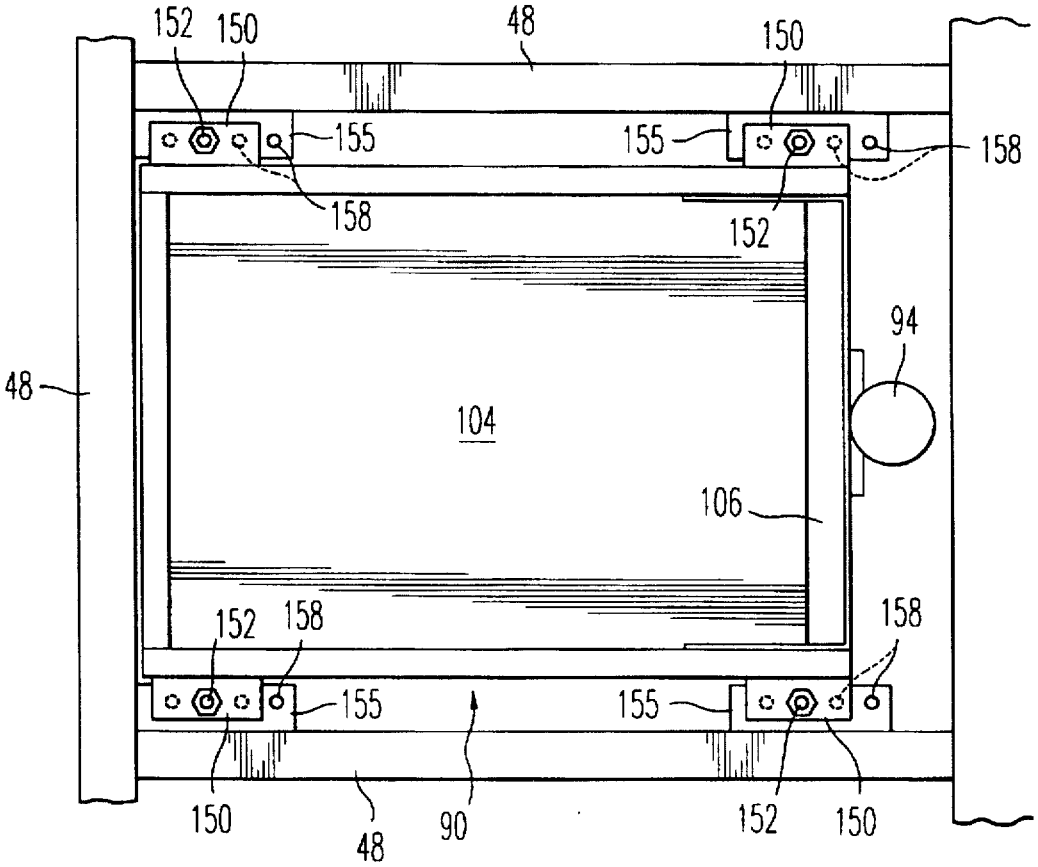
FIG. 10 is a top view of the vibrating feed tray shown in FIG. 9.

FIGS. 8–10 illustrate the manner in which the feed trays 90 and 92 are mounted on the top of the air separation unit 20, as well as the adjustments which can be made to the angles and positions of the feed trays 90 and 92. Taking the feed tray 90 as an example, flanges 150 are provided at the four corners of the feed tray and are formed with holes for receiving the upper threaded metal bolt portions 152 of rubber mounts or isolators 153. The lower threaded metal bolt portions 154 of the isolators 153 pass through mounting plates 155 which are welded to the frame 48 at the top of the air separation unit 20, and serve to secure the feed tray 90 to the top of the air separation unit 20. The cylindrical rubber portions of the isolators 153 are thus clamped between the flanges 150 and plates 155 to provide vibrational isolation between the feed tray 90 and the remainder of the air separation unit 20. This allows the feed tray 90 to vibrate relatively freely with respect to the frame 48, without transmitting vibrational energy to the remaining portions of the air separation unit 20. The flanges 150 are preferably affixed to the feed tray 90 at an angle with respect to the horizontal, as illustrated in FIG. 9, so that the flanges 150 and plates 155 will be horizontal and parallel to each other when the feed tray is at its normal feed angle.

As best seen in FIGS. 8 and 10, a series of additional holes 158 are provided along the length of the plates 155 for receiving the lower isolator bolts 154. This allows the feed tray 90 to be moved fore or aft on the top of the air separation unit 20, simply by removing the isolators 153 and reinstalling them in a different set of holes. As can be appreciated from FIG. 5, the fore or aft repositioning of the feed tray 90 will have the effect of changing the initial drop point of the mixed granular material into the air flow tunnel 59. Depending upon the type of material being separated, this adjustment may be useful in moving the separation point between the two material flows 97 and 98 to the proper position relative to the hopper 68, divider plate 99 and waste conveyor 116. Preferably, the holes 158 are spaced approximately 1.5 inches apart, with a total of 6 available holes being provided for each of the isolators 153 to allow a total fore-and-aft adjustment of 7.5 inches in the position of the feed tray 90.

In addition to changing the location or position of the feed tray 90 as described previously, it is also possible to change the angle of the feed tray (relative to the horizontal) by replacing some or all of the isolators 153 with isolators in which the rubber portions are taller or shorter. For example, in order to increase the inclination angle of the feed tray 90, the height of the isolators 153 at the forward (discharge) end of the feed tray may be decreased or the height of the isolators 153 at the rear (input) end of the feed tray may be increased. If an even greater increase in the angle of the feed tray 90 is desired, both substitutions can be made at the same time. Alternatively, if it is desired to decrease the inclination of the feed tray 90, the isolators 153 at the forward end of the feed tray can be increased in height relative to the isolators 153 at the rear end of the feed tray 90. In either case, the effect will be to vary the angle of the feed tray surface 104 which carries the mixed granular material 80 to be separated. When this angle is increased, the mixed granular material 80 is fed at a greater rate into the air separation unit 20. Conversely, when the angle is decreased, the feed rate of the mixed granular material 80 into the air separation unit 20 decreases. Preferably, the angle of the feed tray 90 is adjustable between approximately 10° and approximately 15° relative to the horizontal.

It will be understood that the foregoing description of the feed tray 90 applies equally to the second feed tray 92. Although the two feed trays 90 and 92 will normally be adjusted to the same angle and to the same fore-and-aft position, this is not strictly required. For example, differences in the fan speeds or air flow characteristics of the two air flow paths within the air separation unit 20 may require the two feed trays 90 and 92 to be adjusted differently in order to produce equivalent separation of the mixed granular material 80.

Figure 11:
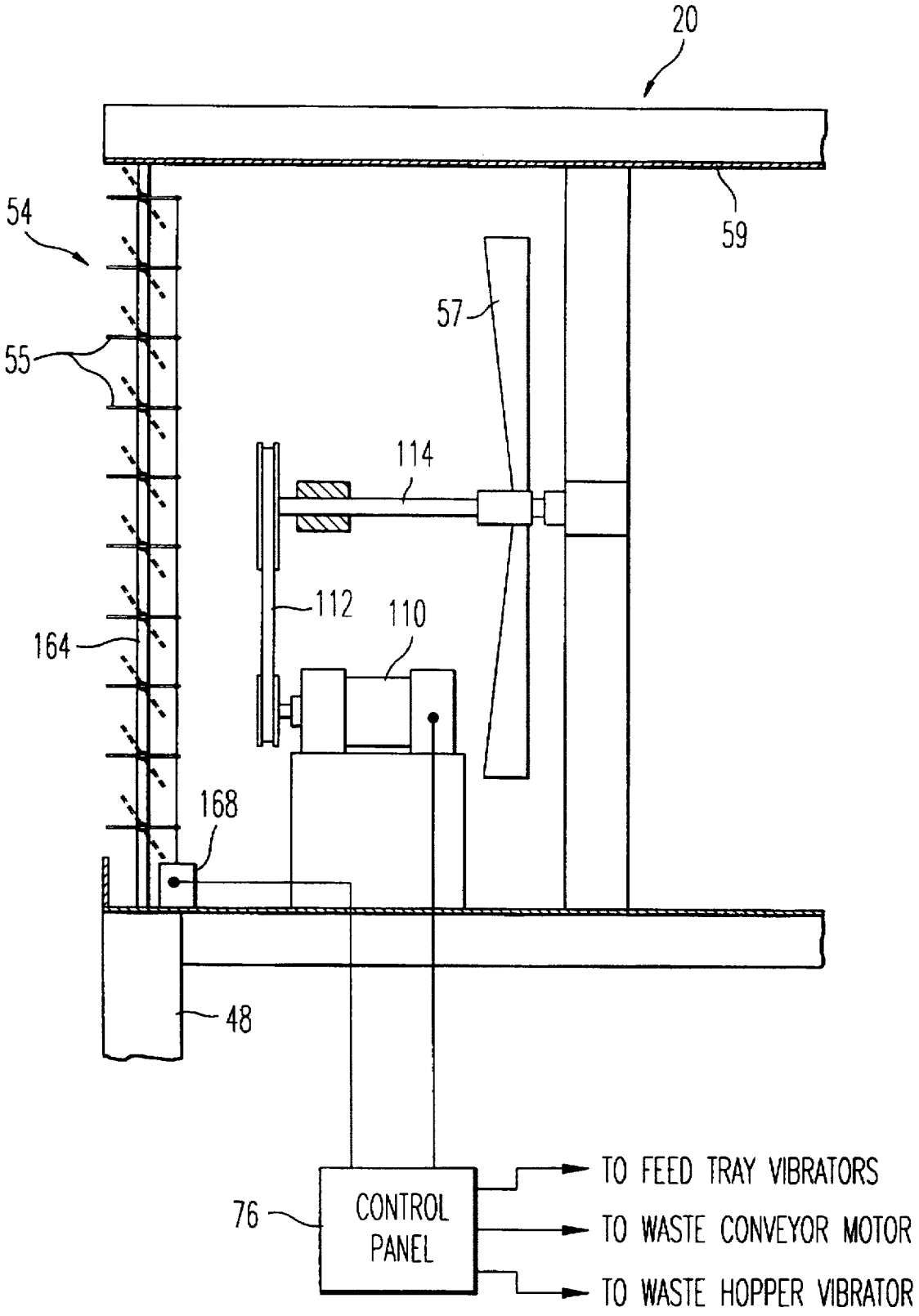
FIG. 11 is a side sectional view of the air inlet end of one of the two parallel air flow paths in the air separation unit shown in FIGS. 2–5.

FIG. 11 is an enlarged cross-sectional view of the inlet portion of the air flow tunnel 59, illustrating in detail the manner in which the louvers or dampers 55 are controlled. The louvers or dampers 55 are carried by vertical support members (one of which is shown at 164) and are pivotable about horizontal axes. In order to control all of the louvers or dampers 55 in parallel, a vertical control rod 166 is secured to the inner edges of the louvers or dampers 55 and is moved upwardly or downwardly by an actuating device 168. The actuating device is of a known type and consists of an electric motor, gear drive and limit switch. By means of an electrical connection to the control panel 76, the actuating device 168 can move the louvers or dampers 55 to any one of an essentially infinite number of positions from fully closed to partially open and fully open. (Suitable controls are also provided on the control panel 76 for the feed tray vibrator motors 94 and 96, for the motor that drives the waste conveyor 116, and for the optional vibrator 119 that is attached to the waste hopper 70.) Alternatively, the actuating device 168 can be configured to move the louvers or dampers 55 between two pre-set positions, such as fully closed and fully open or fully closed and partially open. As a further alternative, the louvers or dampers 55 can be controlled manually by moving them to the desired position and locking the control rod 166 in place by means of a set screw or the like.

Figure 12:
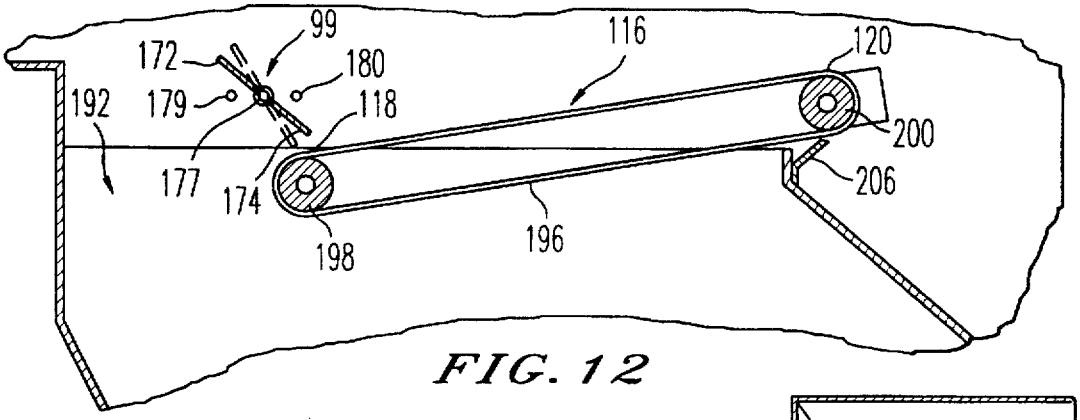
FIG. 12 is a side sectional view of a portion of the bottom interior of one of the two parallel air flow paths in the air separation unit of FIGS. 2–5, illustrating an adjustable divider plate that separates the two granular materials of different specific gravity and the conveyor belt that conveys the lighter granular material to an output hopper.
Figure 13:
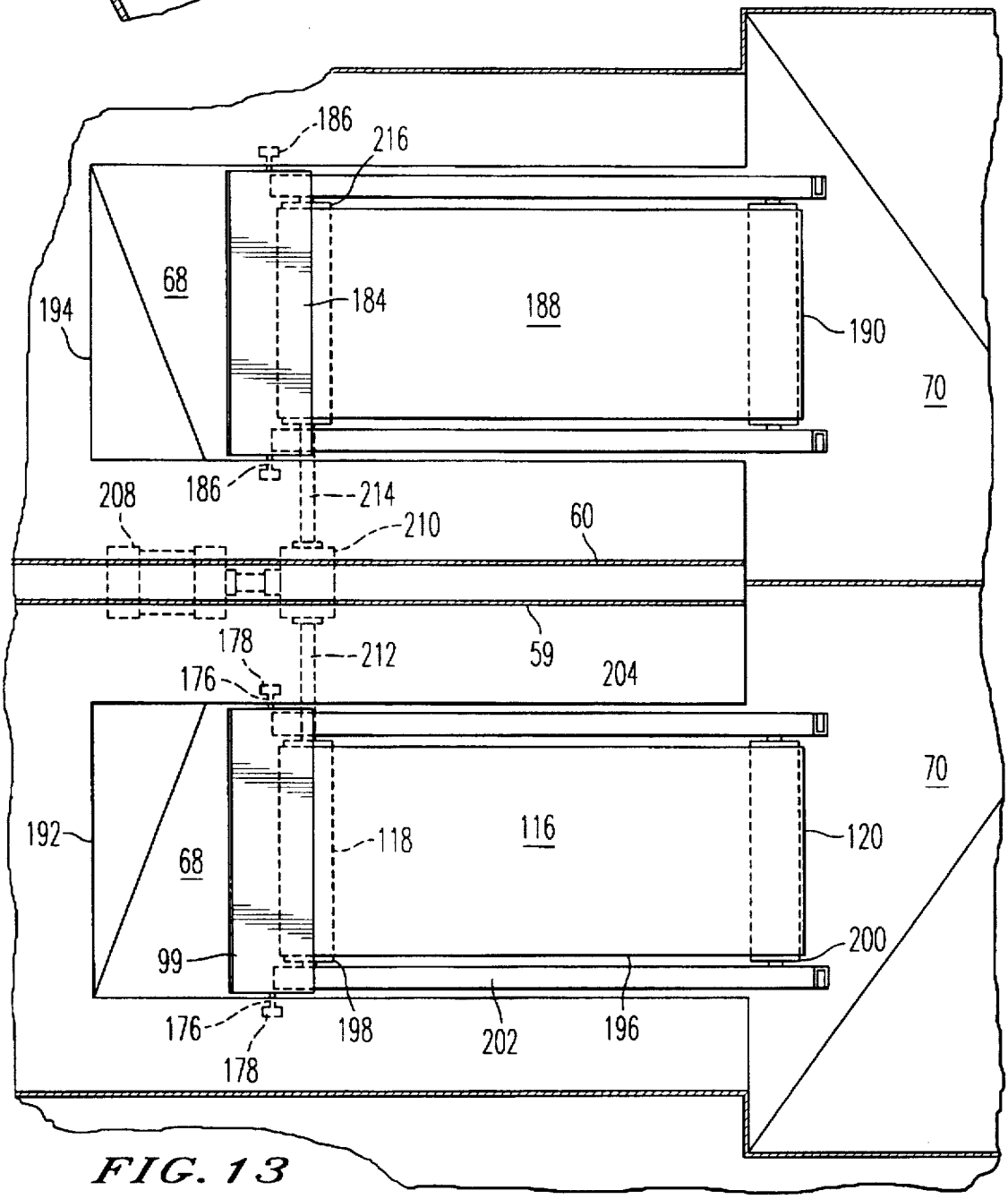
FIG. 13 is a top view showing the divider plates and conveyor belts used in the two parallel air flow paths of the air separation unit.

FIGS. 12 and 13 are detailed views of the divider plate 99 and waste conveyor 116 that are provided in the first air flow path of the separation unit 20, with the corresponding components of the second air flow path also being shown in FIG. 13. As illustrated in FIG. 12, the divider plate 99 is positioned with its upper edge 172 facing the downwardly falling granular material and its lower edge 174 close to (but not in contact with) the surface of the waste conveyor 116 at the input end 118 thereof. As best seen in FIG. 13, the divider plate 99 is rectangular with its lengthwise dimension extending transversely across the width of the air flow tunnel 59. The divider plate 99 is carried by a shaft 176 which extends longitudinally along the median line of the plate 99. The ends of the shaft 176 protrude through holes 177 which communicate with the exterior or the air separation unit 20 at the bottom of the air flow tunnel 59. The protruding ends of the shaft 176 are threaded and are fitted with nuts 178 which can be tightened against the exterior wall of the air separation unit 20 to lock the divider plate 99 at a desired angular position. When the nuts 178 are loosened, the shaft 176 can be rotated to change the angle of the divider plate 99 and thereby make fine adjustments in the position of its upper edge 172. In order to made coarse adjustments in the position of the divider plate 99, the shaft 176 can be withdrawn from the 177 holes and replaced in one of two additional sets of holes 179 and 180 located slightly closer to the inlet and outlet ends, respectively, of the air separation unit 20. In practice, these rotational and translational adjustments of the divider plate 99 can be combined to locate the divider plate 99 in virtually any desired position and orientation relative to the input end 118 of the waste conveyor 116. Preferably, the holes 177, 179 and 180 are spaced so that the maximum amount of fore-and-aft translation or displacement of the shaft 176 is approximately 3 inches. If desired, each of the rows of discrete holes 177, 179 and 180 can be replaced by a continuous slot in which the end of the divider plate shaft 176 is slidably movable. As a further modification, the nuts 178 at the ends of the divider plate shaft 176 may be replaced with a lever, wheel or crank affixed to one end of the shaft 176 for use in changing the angle of the divider plate 99, and a set screw may be used to lock the shaft 176 in the desired angular position.

As illustrated in FIG. 13, the second air flow tunnel 60 contains a divider plate 184 that is identical in all respects to the divider plate 99. The divider plate 184 is carried by a shaft 186 that is independent of the shaft 176 used for the divider plate 99. Therefore, the two divider plates 99 and 184 can be adjusted individually to different positions and orientations if desired. The divider plate 184 is situated at the input end of a waste conveyor 188 that is identical to the waste conveyor 116 described previously. The output ends 120 and 190 of the respective waste conveyors 116 and 188 communicate with the waste hopper 70, which is common to both of the air flow paths within the separation unit 20. The bullet hopper 68 is also common to both of the air flow paths, and separate openings 192 and 194 are formed in the bottom walls of the air flow tunnels 59 and 60, respectively, to communicate with this hopper.

The construction of the waste conveyors 116 and 188 is straightforward and will be described only briefly. Using the waste conveyor 116 as an example, the conveyor includes a rubber belt 196 which is stretched between a powered roller 198 at the input end 118 and an idler roller 200 at the output end 120. The belt 196 is preferably about 30 inches wide and travels about 32 inches between the input end 118 and output end 120. The rollers 198 and 200 are journalled at both ends in longitudinal frame members 202 and 204 which are secured to the bottom of the air flow tunnel 59. A flexible seal or gasket (not shown) may be provided along each edge of the belt 196 to seal the gap which exists between the edge of the belt 196 and the corresponding frame member 202 or 204. In addition, a scraper 206 is preferably mounted below the discharge end 120 of the belt to remove any soil, rocks or debris which does not fall into the waste hopper 70.

The construction of the second waste conveyor 188 is identical to that of the first waste conveyor 116. The two waste conveyors 116 and 188 are powered by a common drive motor 208, the output of which is coupled to a 90° gear box 210. One output shaft 212 of the gear box 210 drives the powered roller 198 of the first waste conveyor 116, and a second output shaft 214 drives the corresponding roller 216 of the second waste conveyor 188. Electrical power is provided to the motor 208 by the control panel 76 of FIGS. 2, 3, 5 and 11, and a variable speed capability may also be provided if desired.

Although the present invention has been described with reference to a preferred embodiment, it will be understood that the invention is not limited to the details thereof. Various substitutions and modifications have been described in the course of the foregoing description, and others will be apparent to those of ordinary skill in the art. All such substitutions and modifications are intended to fall within the scope of the invention as described in the appended claims.

What is claimed is:

1. An apparatus for separating a mixed granular material into granules of at least two different specific gravities or ranges of specific gravity, comprising:

an air flow housing having a top, a bottom, an air inlet at one end thereof, and an air outlet at an opposite end thereof;

a powered air flow source for maintaining an air flow in said air flow housing in a generally horizontal direction from said air inlet to said air outlet;

a granular material feed assembly for feeding said mixed granular material into the top of said housing and for allowing said mixed granular material to fall by gravity to the bottom of said housing while passing across said air flow, said air flow thereby serving to separate granules of a first specific gravity or range of specific gravities from similarly sized granules of a second specific gravity or range of specific gravities less than said first specific gravity or range of specific gravities;

a divider plate disposed in said housing and positioned relative to said granular material feed assembly in such a manner as to maintain said separation between said granules of said first specific gravity or range of specific gravities and said granules of said second specific gravity or range of specific gravities;

a first granular material outlet disposed in the bottom of said housing for receiving separated granules of said first specific gravity or range of specific gravities and discharging said granules from said housing; and a second granular material outlet disposed in the bottom of said housing for receiving separated granules of said second specific gravity or range of specific gravities and discharging said granules from said housing;

wherein said divider plate extends horizontally across said housing in a direction substantially normal to said air flow direction with an upper edge of said divider plate extending into the falling granular material, said divider plate being pivotable about a horizontal axis which extends transversely across said housing and said horizontal axis being displaceable in a direction generally along a longitudinal axis of said housing extending between said air inlet and said air outlet.

2. An apparatus as claimed in claim 1, wherein said divider plate is disposed in the bottom of said housing and is substantially shielded from said air flow.

3. An apparatus as claimed in claim 1, wherein said granular material feed assembly comprises a vibrating feed tray.

4. An apparatus as claimed in claim 3, wherein said vibrating feed tray has an input end and an output end, said tray being mounted at an angle such that said output end is lower than said input end.

5. An apparatus as claimed in claim 4, wherein said angle is adjustable to vary the feed rate of said mixed granular material into said air flow housing.

6. A apparatus as claimed in claim 1, further comprising air flow control means for controlling the velocity of said air flow.

7. An apparatus as claimed in claim 6, wherein said air flow control means comprises a plurality of adjustable dampers mounted on at least one end of said air flow housing.

8. A method for separating a mixed granular material into granules of at least two different specific gravities or ranges of specific gravity, comprising the steps of:

providing an air flow in a generally horizontal direction;

dropping said mixed granular material across said air flow from a drop point above said air flow, said air flow thereby serving to separate granules of a first specific gravity or range of specific gravities from similarly sized granules of a second specific gravity or range of specific gravities;

positioning a divider plate in the path of the falling granules in such a manner as to maintain said separation between said granules of said first specific gravity or range of specific gravities and said granules of said second specific gravity or range of specific gravities;

pivoting said divider plate about a horizontal axis which extends transversely across said generally horizontal air flow and displacing said horizontal axis in a direction generally parallel to the direction of said horizontal air flow, in order to adjust the location of an upper edge of said divider plate in the path of said falling granules.

9. A method as claimed in claim 8, further comprising the step of changing the rate at which said mixed granular material is dropped across said air flow from said drop point.

10. A method as claimed in claim 9, wherein said dropping step is carried out by a vibrating feed tray, and wherein the step of changing said drop rate is carried out by changing the angle of said feed tray relative to the horizontal.

11. A method as claimed in claim 8, further comprising the step of changing the velocity of said air flow.

* * * * *